US008919070B2

(12) United States Patent
Moses et al.

(10) Patent No.: US 8,919,070 B2
(45) Date of Patent: Dec. 30, 2014

(54) SPACER FOR RETAINING CLADDING ELEMENT ON STRUCTURAL BUILDING ELEMENT

(71) Applicant: Technoform Holding GmbH, Kassel (DE)

(72) Inventors: Dirk Moses, Niestetal (DE); Sebastian Ossadnik, Borken (DE); Thomas Orth, Borken (DE); Viktor Maranditsch, Bad Emstal (DE); Ferdinand Bebber, Ahnatal (DE); Thorsten Poehlmann, Kassel (DE); Björn Hubrich, Niestetal (DE)

(73) Assignee: Technoform Holding GmbH, Kassel (DE)

( * ) Notice: Subject to any disclaimer, the term of this patent is extended or adjusted under 35 U.S.C. 154(b) by 0 days.

(21) Appl. No.: 13/801,566

(22) Filed: Mar. 13, 2013

(65) Prior Publication Data

US 2014/0059972 A1 Mar. 6, 2014

Related U.S. Application Data

(60) Provisional application No. 61/695,280, filed on Aug. 30, 2012.

(51) Int. Cl.
*E04F 13/08* (2006.01)

(52) U.S. Cl.
CPC ..... *E04F 13/0835* (2013.01); *E04F 13/0805* (2013.01); *E04F 13/0857* (2013.01)
USPC ..... 52/677; 52/745.21; 52/704; 403/391

(58) Field of Classification Search
CPC ... E04F 13/0805; E04F 1/7612; E04F 1/7616; E04F 1/4107; E04F 1/4135
USPC ..... 52/677, 580, 745.21, 706, 708, 704; 403/391, 392; 248/220.31, 220.41, 248/220.43
See application file for complete search history.

(56) References Cited

U.S. PATENT DOCUMENTS 291,693 A * 1/1884 Cole ..... 403/284
3,083,796 A * 4/1963 Bell, Jr. ..... 403/388

(Continued)

FOREIGN PATENT DOCUMENTS

CA 2 639 128 4/2009
CA 2 732 490 11/2011

(Continued)

OTHER PUBLICATIONS

Communication mailed May 15, 2014 in counterpart EP application 13 753 817.9-1604, including examined claims 1-15.

(Continued)

*Primary Examiner* — Brent W Herring
(74) *Attorney, Agent, or Firm* — J-Tek Law PLLC; Jeffrey D. Tekanic; Scott T. Wakeman

(57) ABSTRACT

A spacer for retaining a cladding element on a building element in a spaced apart relationship has a constant cross-section in its longitudinal direction. The spacer is an at least substantially hollow structure having at least one external wall enclosing an interior space. At least one fastener insertion path extends through the interior space. The fastener insertion path is capable of holding a fastener disposed therein prior to mounting the spacer and cladding element on the building element. The spacer preferably comprises planar surfaces on opposite sides thereof that are configured to abut the cladding element and the building element, respectively.

20 Claims, 4 Drawing Sheets

(56) References Cited

U.S. PATENT DOCUMENTS

| | | | | |
|---|---|---|---|---|
| 4,189,979 | A | 2/1980 | Silverwood | |
| 4,373,315 | A | 2/1983 | Farrant | |
| 4,399,642 | A | 8/1983 | Bard et al. | |
| 4,409,769 | A | 10/1983 | Redman | |
| 4,467,990 | A * | 8/1984 | Wiseman | 248/220.31 |
| 4,495,741 | A | 1/1985 | Pasiecznik | |
| 5,076,035 | A | 12/1991 | Wright | |
| 6,314,698 | B1 | 11/2001 | Johansson | |
| 7,451,579 | B2 * | 11/2008 | Azarin | 52/677 |
| 8,127,507 | B1 | 3/2012 | Bilge | |
| D666,894 | S | 9/2012 | Bombino et al. | |
| 8,635,815 | B2 * | 1/2014 | Bordin | 52/126.1 |
| 2002/0083663 | A1 | 7/2002 | Ballantyne | |
| 2004/0045235 | A1 | 3/2004 | Ley et al. | |
| 2004/0055236 | A1 | 3/2004 | Keith | |
| 2004/0112007 | A1 | 6/2004 | Thibeau | |
| 2004/0128930 | A1 * | 7/2004 | Ohnishi | 52/474 |
| 2005/0262783 | A1 | 12/2005 | Milburn | |
| 2007/0186501 | A1 | 8/2007 | Kuelker | |
| 2008/0155917 | A1 | 7/2008 | Bilge | |
| 2008/0168723 | A1 | 7/2008 | Bilge | |
| 2010/0251651 | A1 | 10/2010 | Mahe et al. | |
| 2013/0174506 | A1 | 7/2013 | Bombino et al. | |

FOREIGN PATENT DOCUMENTS

| | | | |
|---|---|---|---|
| CA | 2 763 058 | | 3/2012 |
| CH | 699 778 | | 4/2010 |
| DE | 2744036 | A | 6/1978 |
| DE | 31 36 450 | | 3/1983 |
| DE | 85 20 914.7 | | 10/1985 |
| DE | 35 09 466 | | 8/1986 |
| DE | 299 00 770 | | 4/1994 |
| DE | 43 39 141 | | 5/1995 |
| DE | 196 00 944 | | 7/1997 |
| DE | 196 23 801 | | 12/1997 |
| DE | 197 07 624 | | 8/1998 |
| DE | 199 01 418 | | 7/2000 |
| DE | 200 05 237 | | 8/2000 |
| DE | 199 15 331 | | 10/2000 |
| DE | 200 10 385 | | 12/2000 |
| DE | 299 15 574 | | 2/2001 |
| DE | 200 21 878 | | 7/2001 |
| DE | 201 14 225 | | 12/2001 |
| DE | 202 01 597 | | 5/2002 |
| DE | 202 02 714 | | 5/2002 |
| DE | 101 47 840 | | 5/2003 |
| DE | 102 23 038 | | 12/2003 |
| DE | 20 2004 006 987 | | 8/2004 |
| DE | 203 19 978 | | 8/2004 |
| DE | 20 2004 004 098 | | 9/2004 |
| DE | 20 2006 002 614 | | 5/2006 |
| DE | 10 2005 002 635 | | 8/2006 |
| DE | 20 2008 004 373 | | 9/2008 |
| DE | 20 2010 000 475 | | 7/2010 |
| DE | 20 2010 006 745 | | 9/2010 |
| EP | 0 045 978 | | 2/1982 |
| EP | 0476524 | | 3/1992 |
| EP | 0 791 698 | | 8/1997 |
| EP | 1 020 578 | | 7/2000 |
| EP | 1 509 660 | | 10/2008 |
| EP | 2122084 | B1 | 6/2012 |
| GB | 2209774 | A | 5/1989 |
| GB | 2 449 360 | | 11/2008 |
| WO | 2008101624 | A | 8/2008 |
| WO | 2014032805 | A | 3/2014 |

OTHER PUBLICATIONS

International Search Report from related PCT application No. PCT/EP2013/002603.

Written Opinion from related PCT application No. PCT/EP2013/002603.

* cited by examiner

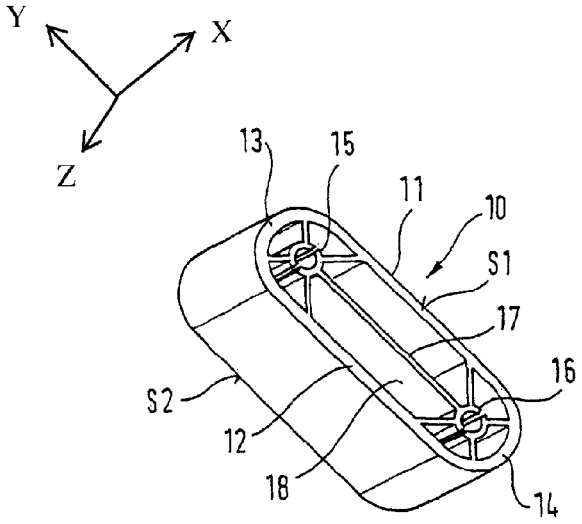
FIG. 1A
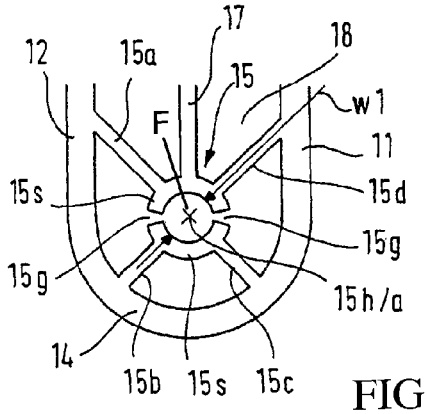
FIG. 1B
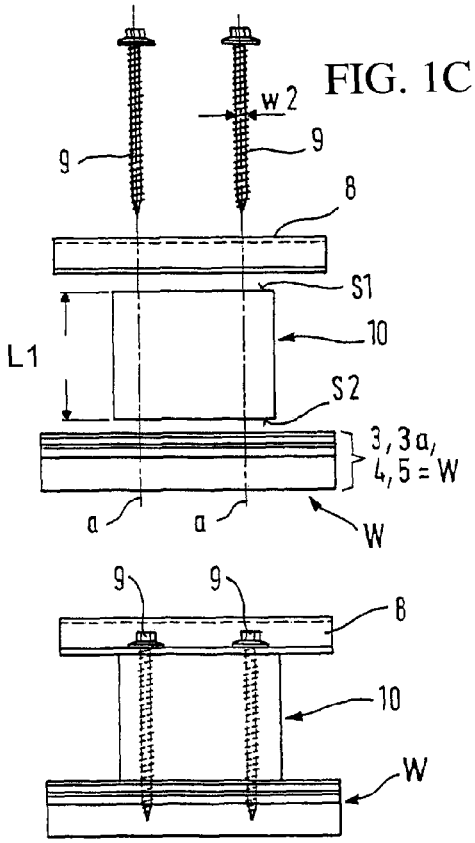
FIG. 1C
FIG. 1D
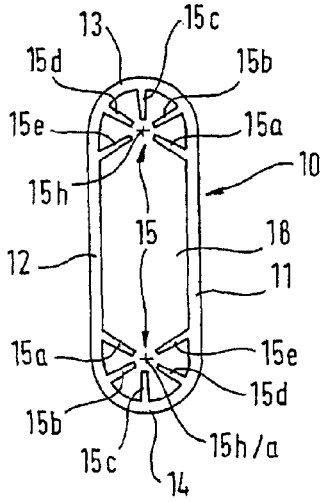
FIG. 2

FIG. 5A
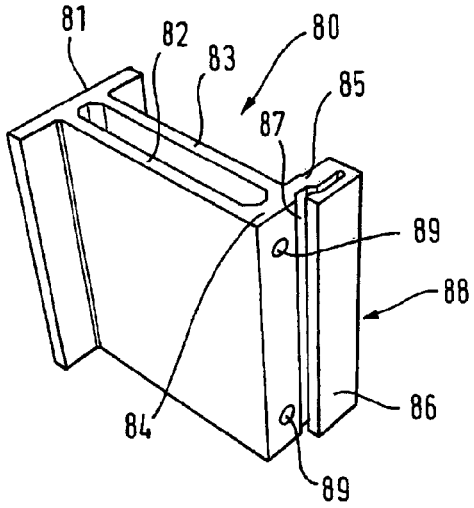
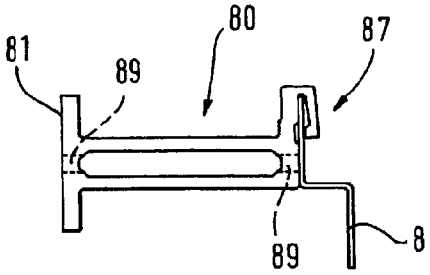
FIG. 5B
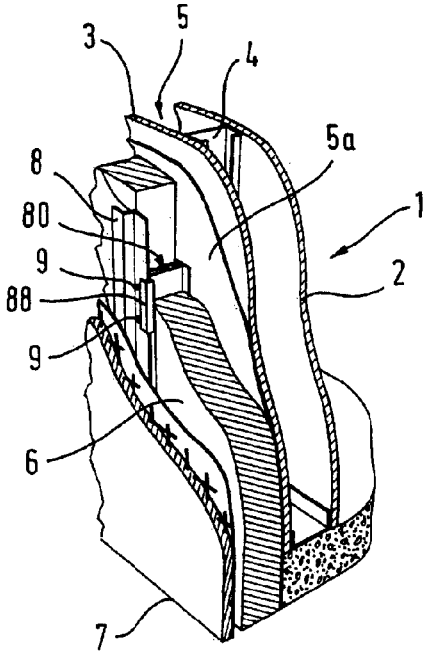
FIG. 5C
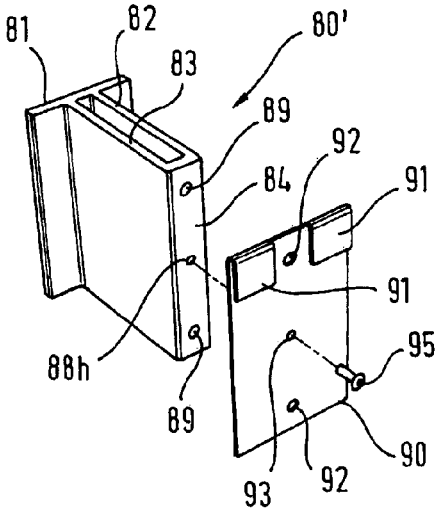
FIG. 5D
PRIOR ART

SPACER FOR RETAINING CLADDING ELEMENT ON STRUCTURAL BUILDING ELEMENT

CROSS-REFERENCE

This application claims priority to U.S. provisional application No. 61/695,280 filed on Aug. 30, 2012, the contents of which are fully incorporated herein.

TECHNICAL FIELD

The present invention generally relates to a spacer for retaining a cladding element (component) in a spaced relationship relative to a structural building element (component).

BACKGROUND ART

In the construction of buildings, cladding elements such as girts, purlins, panels, roof elements, rain walls etc. are often attached to structural building elements such as walls, roofs or other supporting elements such as pillars, studs, etc.

Such a known wall or roof arrangement (assembly) is shown in FIG. 4, which corresponds to FIG. 1 of CA 2 763 058 A1.

In FIG. 4 the wall assembly includes an inner wall panel 2 held in a spaced apart relationship to an outer wall panel 3 by a metal stud 4, thereby forming an interior space 5. The outer wall 3 is covered by an exterior wall cover 3*a*. A steel spacer 70 is attached to the outer wall 3 and the metal stud 4 using screws 71. A C-girt 72 is held at the opposite free end of the spacer 70 spaced apart from the outer wall 3. A cladding component such as a wall panel 7 is attached to the C-girt 72. Insulating material 6 is inserted into the insulation space IS between the outer wall 3 and the cladding wall 7.

The steel spacer 70 is usually screwed into the metal stud 4. Therefore, the thermal insulation properties of the assembly are poor, because the steel spacer 70 acts as a heat conductor through the insulating material IS, thereby defeating the purpose of providing the insulation material.

The modified spacers shown in FIG. 5 were proposed in CA 2 763 058 A1. These spacers are disclosed as being made from an insulating material such as fiberglass-reinforced polymers using pultrusion techniques.

As shown in FIGS. 5A-5C, a first spacer 80 according to CA 2 763 058 comprises a base (flange) 81 configured to be attached to the outer wall 3. Two side walls 82, 83 extend in parallel to each other and perpendicular from the flange 81 (and thus also perpendicular to the exterior wall 3 in the final assembled state), thereby forming a web.

At the end of the side walls 82, 83 opposite to the flange 81, a support member (wall) 84 extends into a first flange portion 85, which is parallel to the flange 81. A second flange portion 86 is provided in parallel to the first flange portion 85, thereby forming a slit 87 therebetween. The two flange portions 85, 86 and the slit 87 together form a guide 88. Screw holes 89 are defined in the flange 81 and the wall 84 and are aligned to form a fastener path, which will be explained further below. The holes 89 are shown in FIG. 5B in dashed lines. As can be seen from FIGS. 5B and 5C, the guide 88 serves to hold a Z-girt 8, which in turn serves to mount a cladding wall 7. The Z-girt 8 is affixed to the spacer 80 using screws 9, which are inserted through the holes 89 and then connected to the wall structure 3, 3*a*, 4, 5.

An alternative embodiment of the spacer 80' described in CA 2 763 058 A1 is shown in FIG. 5D, where the integral guide 88 of FIG. 5A is replaced by a separate guide 90 configured to be attached to the spacer 80' using a screw 95 that will be screwed into hole 88*h*. The guide 90 comprises flanges 91, which again form a slit for inserting a Z-girt. The flange 90 also comprises holes 92 to be aligned with holes 89.

In the embodiments shown in FIGS. 5A and 5D, the interior space between the side walls 82, 83 has a width that is much larger than the diameter of the screw holes 89, through which the screws 9 will be inserted.

Further spacers for wall claddings are known from US 2008/0155917 A1, US 2008/0168723 A1 and U.S. Pat. No. 8,127,507 B1.

SUMMARY

It is an object of the present teachings to disclose improved insulating spacers, which may be utilized to attach cladding elements or components to building structures, such as walls, roofs, pillars, studs, etc.

In one aspect of the present teachings, improved insulating spacers having a simplified structure are disclosed, which preferably also provides advantages in handling when attaching the spacer to a cladding element and to building structure.

In another aspect of the present teachings, improved wall assemblies comprising such spacers and building structures are disclosed.

In a further aspect of the present teachings, an improved assembly of a spacer and a cladding element is disclosed.

In another aspect of the present teachings, a spacer is configured to retain a cladding element on a building element in a spaced apart relationship and has a constant cross-section in its longitudinal direction. The spacer is an at least substantially hollow structure having at least one external wall enclosing an interior space. At least one fastener insertion path extends through the interior space. The fastener insertion path is capable of holding a fastener disposed therein prior to mounting the spacer and cladding element on the building element. The spacer preferably comprises planar surfaces on opposite sides thereof that are configured to abut the cladding element and the building element, respectively.

Spacers according to certain embodiments of the present teachings may be manufactured by extrusion as continuous profiles due their constant cross sections. Because such spacers have a relatively simple structure, the tooling costs and the extrusion costs will be relatively low while still permitting highly precise dimensions to be achieved relatively easily.

In addition or in the alternative, a spacer according to the present teachings may include one or more fastener holding devices formed by extension walls, protrusion ribs or the like. Such fastener holding devices enable a cladding element such as a Z-girt to be pre-attached or pre-mounted in a captive manner by simply inserting the fastener, such as a screw, into a fastener insertion path defined by the fastener holding device. In this case, the spacer, the fastener and the cladding element become a single, integral unit (in the form of a captive assembly) which can be easily handled by the person(s) who will mount or attach the captive assembly onto the building structure or element.

Further objects, embodiments, advantages and designs of the present teachings will be explained in the following, or will become apparent, with the assistance of the exemplary embodiments and the appended Figures.

BRIEF DESCRIPTION OF THE DRAWINGS

FIG. 1A shows a perspective view of an exemplary embodiment of a spacer according to the present teachings.

FIG. 1B shows a plan view of a portion of the embodiment of FIG. 1A.

FIG. 1C shows the spacer of FIGS. 1A and 1B in the process of being mounted or attached onto a wall structure.

FIG. 1D shows the spacer of FIGS. 1A and 1B mounted or attached onto the wall structure.

FIG. 2 shows a plan view of a second exemplary embodiment of a spacer according to the present teachings.

FIG. 5A shows a perspective view of another known spacer.

FIG. 5B shows a side view of the spacer of FIG. 5A.

FIG. 5C shows the spacer of FIG. 5A mounted or attached onto a wall structure.

FIG. 5D shows a perspective view of a further known spacer.

DETAILED DESCRIPTION OF THE INVENTION

Figure 4:
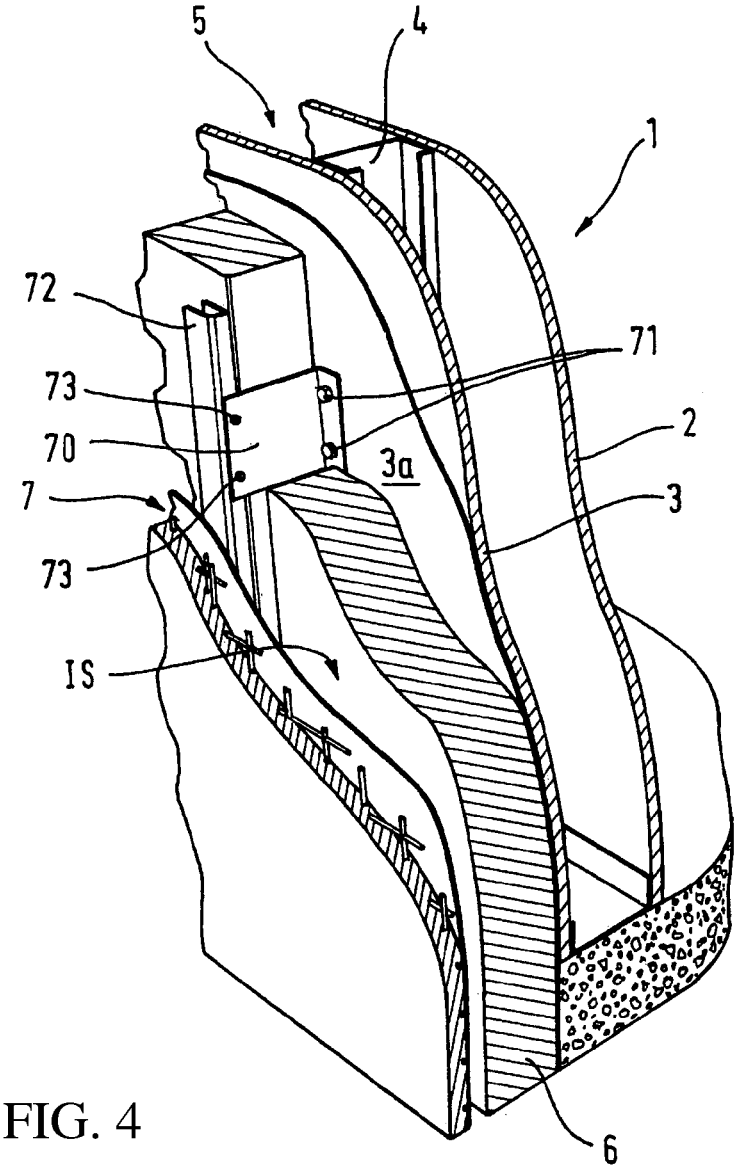
FIG. 4 PRIOR ART
FIG. 4 shows a conventional wall arrangement with a known steel spacer.

For the following description of the preferred embodiments, reference is made to the wall structures shown in FIGS. 4 and 5C as a possible wall or roof structure arrangement for use with the spacers according to the present teachings. Therefore, such description is incorporated herein by reference and need not be repeated. That is, it is understood that the spacers according to the present teachings may be substituted for the spacers 70, 80 shown in FIGS. 4 and 5C, respectively, such that further drawings to show such embodiments are not required.

FIGS. 1A and 1B show a first embodiment of the spacer according to the present teachings and FIGS. 1C and 1D show the spacer during a mounting operation and at the conclusion thereof, respectively.

The embodiment shown in FIG. 1 can be characterized, e.g., as having a tube-like structure, in the sense that it has an at least substantially hollow interior structure with a continuous enclosing (surrounding) wall, preferably a single continuous enclosing (surrounding) exterior wall. However, while the term "tube" is normally associated with hollow cylindrical structures, as used herein, the term "tube-like" is intended to encompass a broader range of substantially hollow structures.

For example, in the present embodiment, the enclosing wall of the spacer has a substantially rectangular cross-section with rounded or curved corners/ends, e.g., a rectangular oval, which is similar in shape to a horse racing track. But, the present teachings are not particularly limited in this regard and alternate cross-sections of the enclosing wall(s) should be understood as falling within the scope of the present teachings.

For example, the corners/ends of the spacer need not be circular in cross-section, but may be more elliptical, or even polygonal, such as pointed (triangular), squared, half-hexagon or half-octagon cross-sections.

In addition or in the alternative, the side walls need not be entirely straight or linear. Instead, the side walls may also be curved, e.g., outwardly or inwardly bowed such that the tube-like structure as a more oval or egg cross-section or an hourglass cross-section, respectively. In addition, the side walls may have a wave-like shape or may include shaper bends defining corners, such as a saw-tooth structure.

It is simply preferred that the body of the tube-like structure has a constant cross-section along its longitudinal length or direction Z, which permits the tube-like structure to be formed by extrusion molding or possibly even by pultrusion.

Referring to FIGS. 1A and 1B, the spacer of the present embodiment comprises a body 10 extending in the longitudinal direction Z with a constant cross section in the X-Y plane perpendicular to this longitudinal direction. More particularly, the body 10 comprises side walls 11, 12, 13, 14 which are connected to each other, preferably in a continuous manner (i.e. integrally without seams therebetween), and extend in the longitudinal direction Z to fully enclose an interior space 18 of the tube-like body 10 in all planes (X-Y) perpendicular to the longitudinal direction Z. Two of the side walls 11, 12 are straight (linear) and extend in parallel in the longitudinal direction X. These straight side walls 11, 12 are connected by curved or arched side walls 13, 14 at the respective ends thereof, which may preferably be circular-segments in cross-section.

As can be seen in FIG. 1C, which is a side view of the tube-like spacer 10, the side walls 11, 12, 13, 14 have planar end faces S1, S2 on the opposite ends in the longitudinal direction Z. The planar end faces S1, S2 extend parallel to each other in a lateral direction X of the spacer 10 and perpendicular to the longitudinal direction Z of the spacer 10.

The body 10 further comprises extension walls 15*a*, 15*b*, 15*c*, 15*d*, which each extend from at least one of the side walls 11, 12, 13, 14 (see FIG. 1B) towards a longitudinally-extending axis F. In this way, the extension walls 15*a* to 15*d* extend, in a view (X-Y plane) perpendicular to the longitudinal direction, in a star-like or substantially X-shaped arrangement, e.g., the extension walls 15*a* to 15*d* each extend radially outward from a point on the axis F. In this arrangement, the extension wall 15*a* extends from the side wall 12 at an angle of approximately 45° (or 135° when viewed from the opposite side). The extension wall 15*d* extends from the side wall 11 at an angle of approximately 45° (or 135° when viewed from the opposite side), wherein the starting points for both extension walls 15*a*, 15*d* on side walls 11, 12, respectively are closer to a middle point of the side walls 11, 12 in the longitudinal direction Z than the axis F. That is, the extension walls 15*a* and 15*d* project from the side walls 11 and 12, respectively, from a point farther from the respective curved side wall 13, 14 in a vertical or height direction Y of the spacer 10 (i.e. the direction perpendicular to both the longitudinal direction Z and the lateral direction X and extending basically in the direction from one side wall 13 to the other side wall 14) than the longitudinally-extending axis F.

Extension walls 15*b*, 15*c* extend towards axis F from a curved side wall 14 (or curved side wall 13 at the opposite end—not shown herein), which is adjacent to and connects side walls 11, 12. Extension wall 15*b* extends in the same plane as extension wall 15*d* and thus approximately at an angle of 90° relative to extension wall 15*a*. Similarly, extension wall 15*c* extends in the same plane as extension wall 15*a* and thus at an angle of approximately 90° relative to extension wall 15*d*. However, the respective pairs of extension walls 15*a*, 15*c* and 15*b*, 15*d* that extend in the same planes are not connected. Rather, each of the extension walls 15*a*-15*d* ends or terminates at a predetermined distance or location that is spaced from axis F.

Furthermore, in the embodiment shown in FIG. 1, first and second (at least substantially) half-cylindrical (spherical) portions (arched walls) 15*s* extend in the longitudinal direction. The first half-cylindrical portion 15*s* is disposed at the tip (terminal) ends of the pair of the adjacent extension walls 15*a*, 15*d* and the second half-cylindrical portion 15*s* is disposed at the tip (terminal) ends of the pair of the adjacent extension walls 15*b*, 15*c*. The two half-cylindrical portions 15*s* are separated by two collinear gaps 15*g*.

Thus, in the embodiment shown in FIGS. 1A and 1B, the extension walls 15*a*-15*d* extend in a substantially cantilever manner from the side walls 11, 12, 13 and 11, 12, 14, respectively, and have an at least substantially plate shape (two-dimensional shape) extending in the longitudinal direction. While the opposite or terminal (free) ends of two adjacent extension walls 15*a*-15*d* are connected by a half-cylindrical (arched) portion 15*s*, the half-cylindrical (arched) portions 15*s* are not supported by the side walls 11, 12, 13, 14 (except via the extension walls 15*a*-15*d*) and are movable relative thereto. Thus, the term "extension wall" as used herein may be replaced with "cantilever" (or "at least substantially cantilever") plate or bar or beam.

Of course, in an alternate embodiment, it is also possible to provide one discrete, arched or curved (e.g., circular arc) wall portion 15*s* for each extension wall 15*a* to 15*d*, such that the four arched wall portions 15*s* are respectively separated by four gaps 15*g* between each of the arched wall portions 15*s*. Thus, in this alternate embodiment, the terminal ends of the extension walls 15*a*-15*d* are not otherwise supported and thus the term "extension wall" may be replaced with "cantilever" plate or bar or beam.

In either embodiment, a fastener insertion path 15*h* is defined along the longitudinally-extending axis F between the wall portions 15*s*. The fastener insertion path 15*h* is open at the end faces S1 and S2 and has a predetermined width w1.

In the embodiment shown in FIG. 1, a second fastener path 15*h* is formed in the same way at the opposite end (in the height direction Y) of the body 10 with corresponding extension walls extending from the side walls 11, 12, 13. Therefore, this description need not be repeated.

Thus, in the interior space 18 defined by the side walls 11, 12, 13, 14, two fastener paths 15*h* are defined that extend along respective axes F (separated in the height direction Y) and thus in parallel in the longitudinal direction Z. Of course, while both fastener paths 15*h* have a predetermined width w1, the amount of the predetermined widths could be the same or different in the two different fastener paths 15*h*.

In the embodiment shown in FIG. 1, an additional connecting wall 17 connects the two half-cylindrical portions 15*s* of the two different fastener paths 15*h* that are closest to each other in the height direction. However, this connection wall 17 is optional.

Preferably, the thickness(es) of the side walls 11, 12, 13, 14 is larger or greater than the thickness(es) of the extension walls 15*a* to 15*d* and the connection wall 17. The side walls 11, 12, 13, 14 may be designed to provide the stability (e.g., stiffness) and/or strength of the spacer 10 that is required to hold and support (retain) a cladding element 7, 8 spaced apart from a building element W. The particular dimensions of the wall thickness(es), the length in the longitudinal direction Z, the width in the lateral direction X, the height in the height direction Y, etc. all depend on the actual, real-world application of the present teachings and may be freely chosen to satisfy particular design requirements in a manner known to the person of ordinary skill in the art.

However, in certain embodiments of the present teachings, the width w1 is preferably selected such that the fastener(s) (e.g., a screw 9 as shown in FIG. 1C) used to attach a cladding element, such as a Z-girt 8, to a wall system W (i.e., 3, 3*a*, 4, 5) has a width w2, which is larger or greater than the width w1. The width w2 of a threaded fastener element (e.g., a screw 9) corresponds to the outer diameter of the thread.

The spacer is preferably formed from a polymer material having a relatively low heat conductivity and preferably having a relative high stiffness, such as one or more fiberglass-reinforced polymers, such as fiberglass-reinforced polyamide (PA), fiberglass-reinforced polybutylene terephthalate (PBT) or fiberglass-reinforced polyethylene terephthalate (PET), but are not limited thereto and may additionally or alternately include polypropylene and/or polycarbonate. Specific materials suitable for use with the present teachings include PBT having 30 wt % glass fibers and PA having 40 wt % glass fibers. Preferred polymer materials preferably exhibit heat conductivities of less than about 5 W/(mK), more preferably less than about 1 W/(mK), and even more preferably less than about 0.3 W/(mK). The polymer material(s) may also contain commonly used fillers, additives, dyes, UV-protection agents, etc. All of these materials are also appropriate for the subsequently described embodiment.

In addition or in the alternative, the spacer body 10 could be provided with one or more co-extruded reinforcement member(s), such as a metal bar, in order to increase the stiffness of the spacer body 10 in the direction of extrusion. This modification is also appropriate for the subsequently described embodiment.

In addition, the extension walls 15*a* to 15*d*, the spherical (curved) portions 15*s* and the connection wall 17, if applicable, are preferably designed or configured such that the fastener path 15*h* and its width w1 have a predetermined widening range, which is a predetermined elasticity range and/or a predetermined plastic deformation range, by which the fastener path 15*h* (width w1) can widen or deform when a fastening element (e.g., screw 9) is inserted therethrough. The widening range is selected to allow a widening or expansion of the width w1 by a certain value, such as x % of w1, where $0.1 \leq x \leq 50$ and preferably $x \geq 0.2$, more preferably $x \geq 0.3$, more preferably $x \geq 0.4$, more preferably $x \geq 0.5$, more preferably $x \geq 2$, and even more preferably $x \geq 5$.

For example, a thermoplastic material, such as fiberglass-reinforced polyamide, has elastic properties/characteristics and plastic deformation properties/characteristics. Preferably, spacers according to the present teachings rely at least primarily on the elastic properties of the material, i.e., the widening range is defined solely or at least substantially by an elastic range of the material, because an elastic widening is reversible. However, if needed or desired, the plastic deformation characteristics/properties of the material can also be used, at least in part, to define the widening range so as to allow/enable the insertion of wider fasteners and to hold the same. Naturally, if the spacer relies on plastic deformation to any significant extent, disassembly is either not intended or could be done by unscrewing. In this case, the spacer would not likely be re-usable.

Thus, when a fastener (e.g., screw 9) is inserted first through a hole in the cladding element (e.g., z-girt 8) and then into the fastener insertion path 15*h*, only a relatively small pushing force is required due to the elasticity of the material. Then, when the fastener 9 has been inserted to a certain depth into the fastener insertion path 15*h*, the fastener 9 is held in the fastener insertion path 15*h* due to the elastic properties of the spacer body 10, such that the spacer, the z-girt 8 and the screw 9 form a captive assembly, i.e. an assembly in which the discrete parts are held together in a captive manner.

Therefore, the arrangement of the extension walls 15*a* to 15*d* and the arched portions 15*s* can be characterized as a fastener holding portion 15 that defines a fastener insertion path 15*h* extending along the longitudinally-extending axis F.

The advantages of this design of the spacer will be apparent to the person of ordinary skill in the art. For example, because the planar and parallel opposite faces S1 and S2 serve as attachment planes respectively configured to flushly abut the structural building element (e.g., wall W) and the cladding element (e.g., the z-girt 8), the spacer 10 does not require any additional guide element for the cladding element 8. Rather, a captive assembly can be prepared using only the spacer 10, the cladding element 8 and the fastener(s) 9.

The spacer is preferably manufactured by extrusion, which enables it to be manufactured in an endless manner and to be cut into elongated bars for shipment to the customer, such as bars having a length of 6 m. In this case, the customer will then cut shorter segments (e.g., segments between 1-15 cm) for use in particular applications. Naturally, the elongated bar can be cut to any arbitrary length L1 in the longitudinal direction Z and the cut length L1 determines the spacing distance between the building element W and the cladding element 8 as shown in FIGS. 1C and 1D.

FIG. 2 shows a second embodiment of a spacer 10 according to the present teachings, which is closely related to the first embodiment. As can be seen in FIG. 2, the connection wall 17 is not present. In addition, the four extension walls 15*a* to 15*d* with the half-cylindrical (arched) portions 15*s* have been replaced by five extension walls 15*a* to 15*e* per fastener insertion path 15*h*. Thus, in the embodiment of FIG. 2, the extension walls 15*a* to 15*e* may also be called "cantilever" plates or bars or beams, because the terminal ends thereof are not supported.

In the same way as the first embodiment, the extension walls 15*a* to 15*e* of FIG. 2 form or define a fastener insertion path 15*h* having a first predetermined width w1. In this embodiment, the width w1 is determined by considering an imaginary a circle defined by the tip (terminal) ends of the extension walls 15 to 15*e*, whereby the diameter of this imaginary circle is considered to be the width w1. The five extension walls 15 to 15*e* extend at angles of approximately 70° between them with one exception. Specifically, the angle between the two extension walls 15*a* and 15*e*, which are disposed closest to the other fastener insertion path 15*h* (or to the center of the spacer in the longitudinal direction Z), form an angle of approximately 90° or more.

For both embodiments shown in FIGS. 1 and 2, the curved side walls 13, 14 each have a radius of curvature, which corresponds to about one-half the distance of the parallel side walls 11, 12 and the center thereof is located approximately on the longitudinally-extending axis F of the corresponding fastener insertion path 15*h* defined adjacent to the corresponding curved side wall 13, 14.

As was discussed above, other cross-sectional shapes of the tube-like spacer are possible in this aspect of the present teachings, such as a circular cross section with one fastener path or a quadratic cross section with rounded edges and four fastener paths etc. However, in each case, the end faces S1, S2 of the tube-like arrangement, which includes one or more fastener insertion path(s) co-linear with or in parallel to the tube axis F, are parallel to each other and serve as respective connection/attachment/abutment faces for the wall/roof and the cladding element to be spaced therefrom.

Figure 3A:
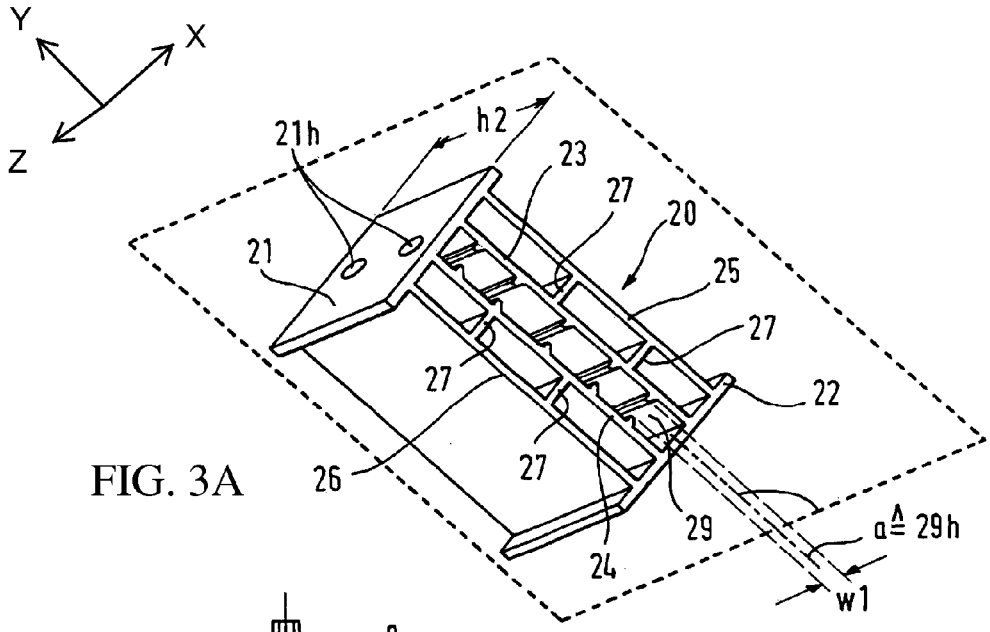
FIG. 3A shows a perspective view of a third exemplary embodiment of a spacer according to the present teachings.
Figure 3B:
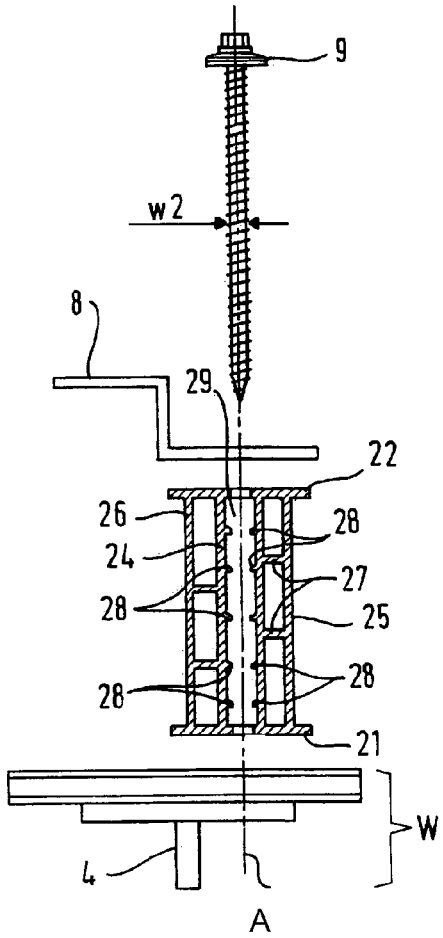
FIG. 3B shows the spacer of FIG. 3A in the process of being mounted or attached onto a wall structure.
Figure 3C:
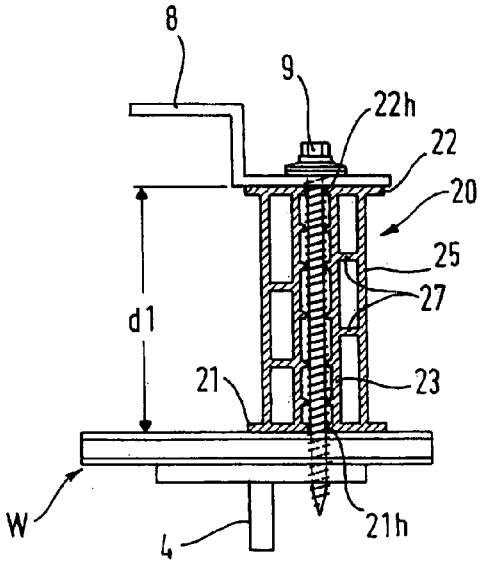
FIG. 3C shows the spacer of FIG. 3A mounted or attached onto the wall structure.

FIG. 3 shows a third embodiment of a spacer according to the present teachings. This embodiment can be considered to be a block-like or block-shaped spacer, in which the body 20 is formed by a set of perpendicular, or essentially perpendicular, walls, as will be described further below. The body 20 of the third embodiment of the spacer comprises two flange walls 21, 22 spaced apart in the height/vertical direction Y of the body 20 and extending parallel to each other in the lateral direction X of the body 20. The flange walls 21, 22 serve as connection/attachment/abutment faces to a wall structure W and to a cladding element 8, respectively, as shown in FIGS. 3B and 3C. Consequently, the flange walls 21, 22 perform essentially the same function as the end faces S1, S2 of the first and second embodiments.

The flange walls 21, 22 are connected by a first set of two parallel side walls 23, 24, which extend perpendicular to the flange walls 21, 22. An interior space 29 is defined by the two flange walls 21, 22 and the two side walls 23, 24; the interior space 29 is fully enclosed in the planes (X-Y) perpendicular to the longitudinal extension Z of the four walls 21, 22, 23, 24. This interior space 29 is open in the longitudinal direction Z that extends parallel to the two flange walls 21, 22 and to the two side walls 23, 24.

The third embodiment shown in FIG. 3 includes a second set of two parallel side walls 25, 26, which are also parallel to the first set of side walls 23, 24. However, the second set of side walls 25, 26 are optional and the person of ordinary skill in the art can readily determine whether to include the second set of side walls 25, 26 in view of the loads to be carried or supported by the spacer 20 in the actual application.

In the embodiment shown in FIG. 3, the side wall 25 is disposed parallel to the side wall 23 on the side thereof opposite to the interior space 29 and is connected to the side wall 23 by two connection walls 27, which are parallel to the flange walls 21, 22 (perpendicular to the side walls 23, 25). The same applies to the other side wall 26, which is parallel to the side wall 24 and is disposed on the side thereof that is opposite to the interior space 29. The side wall 26 is also connected to the side wall 24 by two connection walls 27 that extend parallel to the two flange walls 21, 22.

While two connection walls 27 are shown in the embodiment of FIG. 3, naturally zero, one or more than two connection walls 27 may be utilized depending upon the dimension of the body 10 in the height vertical direction and the loads/forces to be supported by the spacer in the actual application.

In the interior space 29, a plurality of protrusion ribs 28 extend from the side walls 23, 24 into the interior space 29 in the manner described below.

Thus, the block-like shape of the body 20 defines the interior space 29 that is open in the longitudinal direction Z parallel to the flange walls 21, 22 and the side walls 23, 24. Further, the interior space 29 is intersected by a plane Y-Z, which is parallel to and equally spaced from the side walls 23, 24 and thus perpendicular to the flange walls 21, 22. One or more holes 21*h*, 22*h* are respectively defined in the flange walls 21, 22; in the depicted embodiment, there are two holes per flange wall. Each pair of holes 21*h*, 22*h*, which are mutually-opposing in the vertical/height direction Y, are aligned within the Y-Z plane and thus the fastener insertion path(s) defined by each set of mutually-opposing holes 21*h*, 22*h*, is (are) perpendicular to the longitudinal direction Z.

Thus, one fastener insertion path 29*h* is provided for each pair of aligned holes 21*h*, 22*h* through the interior space 29 and through the flange walls 21, 22.

The protrusion ribs 28 are designed or configured such that they limit or narrow the width of each fastener insertion path 29*h* to a first predetermined width w1. That is, the width w1 is defined by the distance between mutually-opposing protrusion ribs 28 as viewed in a plan view (X-Y plane). In this respect, it is important to note that, while the protrusion ribs 28 preferably all have the same height as shown in FIG. 3, the protrusion ribs 28 need be the same height in the lateral direction X in order to achieve such a predetermined width w1.

In the same way as was described above with respect to the first and second embodiments, the fastener insertion paths 29*h* and their widths w1 preferably have a widening range for widening the same, which is preferably at least primarily elastic. The elastic range can be set by appropriately selection of the material and/or the shape of the protrusion ribs 28, as was described above with respect to the first and second embodiments, which is incorporated into this embodiment by reference. Therefore, a fastener (e.g., a screw 9) having a larger second predetermined width w2 (as determined by the cross-wise dimension (diameter) of the screw thread) can be inserted into the fastener insertion path 29*h* and a captive assembly of the cladding element, spacer 20 and fastener 9 can be formed, although such a captive assembly is not shown in FIG. 3.

Naturally, the block-like embodiment shown in FIG. 3 can also be manufactured by extrusion and from the same materials as were described above with respect to the first and second embodiments, which description is thus incorporated by reference into the present embodiment.

However, the direction of the extrusion of the block-like embodiment does not correspond to the direction F of the fastener insertion path 29*h*. Instead, the extrusion direction is perpendicular to the fastener insertion path 29*h*. Accordingly, the spacer 20 can also be produced in an endless manner, cut into elongated bars having a length, for example, of 6 m for shipment to the customer, and then cut into shorter segments of a predetermined height h2. However, unlike in the first and second embodiment, this height h2 does not determine the spacing distance d1 between the wall structure W and the cladding element 8; rather, the height h2 determines the areas of contact with the wall structure W and the cladding element 8, respectively.

Thus, this third embodiment enables the contact area to be variable by cutting the bars into different lengths h2. However, the spacing distance d1 is not variable. On the other hand, in the first and second embodiments, the spacing distance h1 was variable, whereas the contact area was not.

But, with all embodiments of the present teachings, a captive assembly of cladding element, spacer and fastener can be obtained without requiring any additional guide element or any other additional element.

The spacers according to the present teachings can, of course, also be manufactured by other manufacturing methods such as pultrusion, injection molding and the like, but the above described extrusion is preferred.

Further embodiments of the present teachings include, but are not limited to:

1. A spacer (10) for spacing a cladding element (8, 7) from a building element (W, 3, 3*a*, 4, 5), comprising:

a spacer body having at least one fastener path (15*h*) extending along a fastener insertion axis (a) and side walls (11, 12, 13, 14) extending in parallel to the fastener insertion axis (a) and defining an interior space (18), which is open on opposing sides in the direction of the fastener insertion axis (a) and fully enclosed with a constant cross section in any plane (or all planes) perpendicular to the fastener insertion axis (a), wherein the at least one fastener path (15*h*) is formed by extension walls (15*a-d, s*; 15*a-e*) extending from the side walls (11-14) into the interior space (18) to define a first predetermined width of the fastener path (15*h*) perpendicular to the fastener insertion axis (a) with a widening range for widening the fastener insertion path, which enables insertion of a fastener (9) along the fastener insertion axis (a) having a second predetermined width perpendicular to the fastener insertion axis (a) larger than the first predetermined width within the widening range.

2. The spacer according to embodiment 1, wherein the widening range is at least 0.5%, more preferably at least 5% and up to 50% of the first predetermined width.

3. The spacer according to embodiment 1 or 2, wherein the widening range is defined by an elasticity range for widening the insertion path and/or a plastic deformation range for widening the fastener insertion path.

4. The spacer of any preceding embodiment, wherein the side walls (11-14) define two parallel end faces (S1, S2), which are perpendicular to the fastener insertion axis (a).

5. The spacer according to any preceding embodiment, wherein the extension walls (15*a-d, s*; 15*a-e*) are formed in a star-like (star-shaped) arrangement around the fastener insertion path (15*h*).

6. The spacer according to any preceding embodiment, wherein spherical or half-cylindrical portions (15*s*) are provided at the tips of the extension walls (15*a-d*) at the fastener insertion path side of the extension wall, the spherical portions (15*s*) being spaced by gaps (15*g*).

7. The spacer according to any preceding embodiment, wherein at least two fastener insertion paths (15*h*) are provided.

8. The spacer according to any preceding embodiment, further comprising a connection wall (17) extending in the interior space (18) between one of the spherical or half-cylindrical portions (15*s*) at one of the at least two fastener insertion paths (15*h*) and one of the spherical or half-cylindrical portions (15*s*) at another one of the at least fastener insertion paths (15*h*).

9. The spacer according to any preceding embodiment, wherein at least two fastener insertion paths (15*h*) are provided.

10. A spacer (20) for spacing a cladding element (8, 7) from a building element (W, 3, 3*a*, 4, 5), comprising:

a spacer body (20) having at least one fastener path (29*h*) extending along a fastener insertion axis (a) and two flange walls (21, 22) extending parallel to each other and perpendicular to the fastener insertion axis (a) and two side walls (23, 24) extending parallel to each other and perpendicular to the fastener insertion axis (a) and connecting the two flange walls (21, 22) to form an interior space (29) which is open on opposing sides in a direction (z) perpendicular to the fastener insertion axis (a) and parallel to the side walls (23, 24) and is fully enclosed with a constant cross section in any plane perpendicular to the flange walls (21, 22) and to the side walls (23, 24) and comprises the at least one fastener path (29*h*), wherein protrusion ribs (28) extend from the side walls (23, 24) into the interior space (29) to define a first predetermined width (w1) of the fastener path (29*h*) perpendicular to the fastener insertion axis (a) with a widening range for widening the fastener insertion path (29*h*), which enables insertion of a fastener (9) along the fastener insertion axis (a) having a second predetermined width (w1) perpendicular to the fastener insertion axis (a), which is larger than the first predetermined width within the widening range.

11. The spacer according to embodiment 10, wherein the widening range is at least 0.2%, more preferably at least 2.5% and up to 50% of the first predetermined width.

12. The spacer according to embodiment 10 or 11, wherein the widening range is defined by an elasticity range for widening the insertion path and/or a plastic deformation range for widening the fastener insertion path.

13. The spacer according to any one of embodiments 10-12, wherein each of the flange walls (21, 22) includes one aperture (21*h*, 22*h*) per fastener path (15*h*), which are aligned in the direction of the fastener insertion axis (a).

14. The spacer according to any one of embodiments 10-13, further comprising at least one additional side wall (25, 26) extending in parallel to an adjacent one of the two side walls (23, 24) outside of the interior space (29) and connected to the flange walls (21, 22).

15. The spacer according to embodiment 14, wherein the additional side wall (25, 26) is connected to the adjacent side wall (23, 24) by at least one connecting wall (27).

16. The spacer according to any one of embodiments 10-15, wherein at least two fastener paths (29*h*) are provided in the interior space (29).

17. A wall or roof arrangement having a building element (W, 3, 3*a*, 4, 5) and a cladding element (8, 7), which are held spaced apart by a spacer (10; 20) according to any one of embodiments 1 to 16.

18. The arrangement according to embodiment 17, wherein the spacer (10) is the spacer according to one of embodiments 1 to 9 and the spacing distance between the building element and the cladding element is defined by a height (h1) of the side walls (11-14).

19. The arrangement according to embodiment 17, wherein the spacer is the spacer (20) according to any one of embodiments 10 to 16, wherein the spacing distance (d1) between the building element and the cladding element is defined by the distance (h2) of the two flange walls (21, 22).

20. An assembly of a spacer (10; 20) according to any one of embodiments 1 to 16 and a cladding element (8) which is connected to the spacer (10; 20) in a captive manner by at least one fastener (8) having a second predetermined width (w2) larger than the first predetermined width (w1) within the widening range and being inserted into the fastener path (15*h*; 29*h*).

21. A spacer configured or adapted to retain in a spaced apart relationship, the spacer having a spacer body comprising:

at least one exterior wall extending in parallel to a longitudinal direction of the spacer body and defining an interior space that is open at opposite ends of the spacer body in the longitudinal direction, the at least one exterior wall having a constant cross-section in the longitudinal direction and enclosing the interior space in the plane perpendicular to the longitudinal direction, and a first plurality of bars, each extending in a cantilever or a substantially cantilever manner from an interior surface of the at least one exterior wall into the interior space towards a fastener insertion axis that is parallel to the longitudinal direction, wherein each bar has a constant cross-section in the longitudinal direction and terminates before the fastener insertion axis, the terminal ends of the bars together defining a fastener insertion path having a first predetermined width in a direction perpendicular to the fastener insertion axis, wherein the fastener insertion path is configured to elastically widen to receive and squeeze a fastener having a second predetermined width that is greater than the first predetermined width.

22. The spacer according to embodiment 21, wherein the fastener insertion path is configured to widen within a widening range that is between 0.5-50% of the first predetermined width, more preferably at least 5% of the first predetermined width.

23. The spacer according to embodiment 22, wherein the widening range is defined exclusively by an elastic range of widening of the material of the spacer body, e.g., the widening range is less than or equal to the elongation-at-break of the material of the spacer body.

24. The spacer according to embodiment 22, wherein the widening range is defined in part by an elastic range of widening of the material of the spacer body and in part by a plastic deformation range of the material of the spacer body e.g., the widening range is greater than the elongation-at-break of the material of the spacer body.

25. The spacer according to any one of embodiments 21-24, wherein the spacer body is made of a polymer material, e.g., a single polymer material, preferably fiberglass-reinforced polymer, more preferably a material selected from the group consisting of fiberglass-reinforced PA, fiberglass-reinforced PBT and fiberglass-reinforced PET, and optionally has a heat conductivity of less than about 5 W/(mK), more preferably less than about 1 W/(mK), and even more preferably less than about 0.3 W/(mK).

26. The spacer according to any one of embodiments 21-25, wherein the at least one exterior wall is comprised of a plurality of side wall segments that are integrally connected together without a seam therebetween.

27. The spacer according to embodiment 26, wherein at least one of the side wall segments is curved and at least two of the bars extend from the interior surface of the at least one curved side wall segment.

28. The spacer according to embodiment 27, wherein the at least one curved side wall segment has a half-circle shape in cross-section.

29. The spacer according to any one of embodiments 26-28, wherein at least two of the side wall segments are planar in the direction parallel to the longitudinal direction and extend in parallel to each other.

30. The spacer according to embodiment 29, wherein the curved side wall segment of claim 27 or 28 is integrally connected to respective ends of the at least two planar side walls.

31. The spacer according to any one of embodiments 21-30, wherein two parallel end faces are defined on opposite ends of the spacer body in the longitudinal direction.

32. The spacer according to embodiment 31, wherein the parallel end faces are flat and extend the plane perpendicular to the longitudinal direction.

33. The spacer according to any one of embodiments 21-32, wherein the bars are arranged in a star-like or star-shaped or substantially X-shaped manner around the fastener insertion path.

34. The spacer according to any one of embodiments 21-33, wherein at least four bars are provided.

35. The spacer according to any one of embodiments 21-34, wherein at least five bars are provided.

36. The spacer according to any one of embodiments 21-35, further comprising first and second curved or half-cylindrical portions disposed at the fastener insertion path side of the extension wall, the curved or half-cylindrical portions being separated by two co-linear gaps.

37. The spacer according to claim 36, wherein each of the first and second curved or half-cylindrical portions is integrally connected to the terminal ends of two bars.

38. The spacer according to any one of embodiments 21-35, further comprising an individual arc segment integrally connected to the terminal end of each bar, the individual arc segments collectively defining the fastener insertion path.

39. The spacer according to any one of embodiments 21-38, wherein at least two fastener insertion paths are provided within the spacer body.

40. The spacer according to embodiment 39, further comprising:

a second plurality of bars, each extending in a cantilever or a substantially cantilever manner from an interior surface of the at least one exterior wall into the interior space towards a second fastener insertion axis that is parallel to the first fastener axis, wherein each bar has a constant cross-section in the longitudinal direction and terminates before the second fastener insertion axis, the terminal ends of the bars together defining a second fastener insertion path having a third predetermined width in a direction perpendicular to the second fastener insertion axis, wherein the second fastener insertion path is configured to elastically widen to receive and squeeze a fastener having a second predetermined width that is greater than the third predetermined width and the third predetermined width is optionally equal to the first predetermined width.

41. The spacer according to embodiment 39 or 40, further comprising:

a connection wall extending in the interior space between the two fastener insertion paths.

42. The spacer according to embodiment 41, wherein the connection wall extends from one of the curved or half-cylindrical portions at one fastener insertion path to one of the curved or half-cylindrical portions at the other fastener insertion path.

43. The spacer according to any one of embodiments 21-42, wherein the bars are spaced from each other along the interior surface of the at least one exterior wall by one or more angles between 40-120°.

44. The spacer according to embodiment 43, wherein at least some of the bars are spaced from each other by an angle between 60-80°.

45. The spacer according to embodiment 43 or 44, wherein at least two bars are spaced from each other by an angle greater than 90°.

46. The spacer according to any one of embodiments 21-45, wherein the fastener insertion path has a substantially circular cross-section in the plane perpendicular to the longitudinal direction.

47. The spacer according to any one of embodiments 21-46, wherein the at least one external wall has an oval or egg shaped cross-section or has an hourglass cross-section.

48. The spacer according to any one of embodiments 21-46, wherein the at least one external wall as a polygonal cross-section in at least one section thereof.

49. The spacer according to any one of embodiments 21-48, wherein the spacer body is adapted or configured to retain the cladding element and the building element at a distance of 1-15 centimeters.

50. The spacer according to any one of embodiments 21-49, wherein the spacer body is formed by extrusion.

51. A spacer configured to retain a cladding element on a building element in a spaced apart relationship, the spacer having a spacer body comprising:

first and second flange walls extending in parallel to each other and perpendicular to a fastener insertion axis, first and second side walls extending in parallel to each other and perpendicular to the fastener insertion axis, the first and second side walls integrally connecting the two flange walls to define an at least substantially hollow interior space that is open on both mutually-opposing sides in a direction, which is perpendicular to the fastener insertion axis and is parallel to the first and second side walls, the at least substantially hollow interior space being fully enclosed and having a constant cross section in a longitudinal direction thereof, at least one fastener insertion path defined in the interior space and being collinear with the fastener insertion axis, and a first plurality of protrusion ribs projecting from each of the first and second side walls into the interior space in a cantilever manner, wherein the protrusion ribs define a first predetermined width of the fastener insertion path, the first predetermined width is perpendicular to the fastener insertion axis, and the fastener insertion path is configured to widen to receive and squeeze a fastener having a second predetermined width that is greater than the first predetermined width.

52. The spacer according to embodiment 51, wherein the fastener insertion path is configured to widen within a widening range that is between 0.2%-50% of the first predetermined width, more preferably at least 2.5% of the first predetermined width.

53. The spacer according to embodiment 52, wherein the widening range is defined exclusively by an elastic range of widening of the material of the spacer body, e.g., the widening range is less than or equal to the elongation-at-break of the material of the spacer body.

54. The spacer according to embodiment 52, wherein the widening range is defined in part by an elastic range of widening of the material of the spacer body and in part by a plastic deformation range of the material of the spacer body, e.g., the widening range is greater than the elongation-at-break of the material of the spacer body.

55. The spacer according to any one of embodiments 51-54, wherein the spacer body is made of a polymer material, e.g., a single polymer material, preferably fiberglass-reinforced polymer, more preferably a material selected from the group consisting of fiberglass-reinforced PA, fiberglass-reinforced PBT and fiberglass-reinforced PET, and optionally has a heat conductivity of less than about 5 W/(mK), more preferably less than about 1 W/(mK), and even more preferably less than about 0.3 W/(mK).

56. The spacer according to any one of embodiments 51-55, wherein an aperture is defined in each of the first and second flange walls at opposite ends of the fastener insertion path, the apertures being aligned in the direction of the fastener insertion axis.

57. The spacer according to any one of embodiments 51-56, further comprising:

at least one third side wall extending in parallel to the first side wall or the second side wall and outside of the interior space, the at least one third side wall being integrally connected to the first and second flange walls without a seam therebetween.

58. The spacer according to embodiment 57, further comprising:

at least one connecting wall integrally connecting the at least one third side wall to the first side wall or the second side wall without a seam therebetween.

59. The spacer according to any one of embodiments 51-58, wherein at least two fastener insertion paths are defined in the interior space.

60. The spacer according to embodiment 59, further comprising:

a second plurality of protrusion ribs projecting from each of the first and second side walls into the interior space in a cantilever manner and defining a second fastener insertion path spaced from the first fastener insertion path in the longitudinal direction of the spacer body, wherein the protrusion ribs define a third predetermined width of the second fastener insertion path, the third predetermined width is perpendicular to the fastener insertion axis, the second fastener insertion path is configured to widen to receive and squeeze a fastener having a second predetermined width that is greater than the third predetermined width and the third predetermined width is optionally equal to the first predetermined width.

61. An assembly comprising:

a structural building element, a cladding element and the spacer according to any one of embodiments 21-60 fixedly connected to the structural building element and to the cladding element and retaining the cladding element spaced apart from the structural building element.

62. The assembly according to embodiment 61, wherein the spacer is the spacer according to any one of embodiments 21 to 49 and the spacing distance between the structural building element and the cladding element is defined by the length of the spacer in the longitudinal direction thereof.

63. The assembly according to embodiment 61, wherein the spacer is the spacer according to any one of embodiments 51-60 and the spacing distance between the structural building element and the cladding element is defined by the distance between the first and second flange walls in along the fastener insertion axis.

64. An assembly comprising:

the spacer according to any one of embodiments 21-60 and a cladding element coupled to the spacer in a captive manner by at least one fastener inserted into the fastener insertion path and having a second predetermined width that is greater than the first predetermined width.

65. A method comprising:

inserting a fastener through a cladding element and then into the fastener insertion path of the spacer according to any one of claims 1-16 or 21-60, thereby forming a captive assembly of the fastener, cladding element and the spacer.

66. The method according to embodiment 65, further comprising:

engaging the fastener into a structural building element, thereby forming an assembly of the cladding element retained on the structural building element in a spaced apart relationship.

Representative, non-limiting examples of the present invention were described above in detail with reference to the attached drawings. This detailed description is merely intended to teach a person of skill in the art further details for practicing preferred aspects of the present teachings and is not intended to limit the scope of the invention. Furthermore, each of the additional features and teachings disclosed above may be utilized separately or in conjunction with other features and teachings to provide improved spacers, as well as methods for manufacturing and using the same.

Moreover, combinations of features and steps disclosed in the above detailed description may not be necessary to practice the invention in the broadest sense, and are instead taught merely to particularly describe representative examples of the invention. Furthermore, various features of the above-described representative examples, as well as the various independent and dependent claims below, may be combined in ways that are not specifically and explicitly enumerated in order to provide additional useful embodiments of the present teachings.

All features disclosed in the description and/or the claims are intended to be disclosed separately and independently from each other for the purpose of original written disclosure, as well as for the purpose of restricting the claimed subject matter, independent of the compositions of the features in the embodiments and/or the claims. In addition, all value ranges or indications of groups of entities are intended to disclose every possible intermediate value or intermediate entity for the purpose of original written disclosure, as well as for the purpose of restricting the claimed subject matter.

The invention claimed is:

1. A spacer configured to retain a cladding element on a building element in a spaced apart relationship, the spacer having a spacer body formed from a polymer material and comprising:

at least one exterior wall extending in parallel to a longitudinal direction of the spacer body and defining an interior space that is open at opposite ends of the spacer body in the longitudinal direction, the at least one exterior wall having a constant cross-section in the longitudinal direction and enclosing the interior space in a plane perpendicular to the longitudinal direction, the at least one exterior wall being comprised of a plurality of side wall segments that are integrally connected together without a seam therebetween, a first plurality of bars, each extending in a cantilever or a substantially cantilever manner from an interior surface of the at least one exterior wall into the interior space towards a first fastener insertion axis that is parallel to the longitudinal direction, wherein each of the first plurality of bars has a constant cross-section in the longitudinal direction and terminates before the first fastener insertion axis, such that terminal ends of the first plurality of bars together define a first fastener insertion path having a first predetermined width in a direction perpendicular to the first fastener insertion axis, and a second plurality of bars, each extending in a cantilever or a substantially cantilever manner from the interior surface of the at least one exterior wall into the interior space towards a second fastener insertion axis that is parallel to the longitudinal direction and to the first fastener insertion axis, wherein each of the second plurality of bars has a constant cross-section in the longitudinal direction and terminates before the second fastener insertion axis, such that terminal ends of the second plurality of bars together define a second fastener insertion path having the first predetermined width in a direction perpendicular to the second fastener insertion axis, wherein the side wall segments define two parallel end faces, which are perpendicular to the first fastener insertion axis and to the second fastener insertion axis, the first fastener insertion path and the second fastener insertion path are respectively configured to widen to receive and squeeze a fastener having a second predetermined width that is greater than the first predetermined width, and the first fastener insertion path and the second fastener insertion path are respectively configured to be widenable within a widening range that is between 0.5%-50% of the first predetermined width.

2. The spacer according to claim 1, wherein the bars of the first plurality of bars extend in a star arrangement around the first fastener insertion path and the bars of the second plurality of bars extend in a star arrangement around the second fastener insertion path.

3. The spacer according to claim 1, wherein the first and second plurality of bars each comprise at least four bars.

4. The spacer according to claim 3, further comprising:

a first half-cylindrical portion disposed at, and connecting, a first set of the terminal ends of two adjacent bars of the first plurality of bars, and a second half-cylindrical portion disposed at, and connecting, a second set of the terminal ends of two adjacent bars of the first plurality of bars, wherein the first and second half-cylindrical portions are separated from each other by two co-linear gaps.

5. The spacer according to claim 4, further comprising:

a connection wall extending in the interior space between the first and second fastener insertion paths.

6. The spacer according to claim 1, wherein the bars of the first plurality of bars and the bars of the second plurality of bars are respectively spaced from each other along the interior surface of the at least one exterior wall by one or more angles between 40-120°.

7. The spacer according to claim 1, wherein the spacer body is formed by extrusion.

8. The spacer according to claim 1, wherein at least one of the plurality of side wall segments is curved and at least two of the bars of the first plurality of bars extend from the interior surface of the at least one curved side wall segment.

9. The spacer according to claim 8, wherein:

the at least one curved side wall segment has a half-circle shape in cross-section and at least two of the plurality of side wall segments are planar in the direction parallel to the longitudinal direction and extend in parallel to each other.

10. The spacer according to claim 9, wherein the two parallel end faces are defined on opposite ends of the spacer body in the longitudinal direction, the two parallel end faces being flat and respectively extending in first and second planes that are each perpendicular to the longitudinal direction.

11. A spacer configured to retain a cladding element on a building element in a spaced apart relationship, the spacer having a spacer body comprising:

at least one exterior wall extending in parallel to a longitudinal direction of the spacer body and defining an interior space that is open at opposite ends of the spacer body in the longitudinal direction, the at least one exterior wall having a constant cross-section in the longitudinal direction and enclosing the interior space in a plane perpendicular to the longitudinal direction, the at least one exterior wall being comprised of a plurality of side wall segments that are integrally connected together without a seam therebetween, a first plurality of bars, each extending in a cantilever or a substantially cantilever manner from an interior surface of the at least one exterior wall into the interior space towards a first fastener insertion axis that is parallel to the longitudinal direction, wherein each of the first plurality of bars has a constant cross-section in the longitudinal direction and terminates before the first fastener insertion axis, such that terminal ends of the first plurality of bars together define a first fastener insertion path having a first predetermined width in a direction perpendicular to the first fastener insertion axis, and a second plurality of bars, each extending in a cantilever or a substantially cantilever manner from the interior surface of the at least one exterior wall into the interior space towards a second fastener insertion axis that is parallel to the longitudinal direction and to the first fastener insertion axis, wherein each of the second plurality of bars has a constant cross-section in the longitudinal direction and terminates before the second fastener insertion axis, such that terminal ends of the second plurality of bars together define a second fastener insertion path having the first predetermined width in a direction perpendicular to the second fastener insertion axis, wherein the side wall segments define two parallel end faces, which are perpendicular to the first fastener insertion axis and to the second fastener insertion axis, the first fastener insertion path and the second fastener insertion path are respectively configured to widen to receive and squeeze a fastener having a second predetermined width that is greater than the first predetermined width, the first fastener insertion path and the second fastener insertion path are respectively configured to be widenable within a widening range that is between 0.5%-50% of the first predetermined width, the bars of the first plurality of bars extend in a star arrangement around the first fastener insertion path and the bars of the second plurality of bars extend in a star arrangement around the second fastener insertion path and the spacer body is made of fiberglass-reinforced polymer material.

12. The spacer according to claim 11, wherein the spacer body has a heat conductivity of less than about 1 W/(mK).

13. The spacer according to claim 12, wherein at least one of the plurality of side wall segments is curved and at least two of the bars of the first plurality of bars extend from the interior surface of the at least one curved side wall segment.

14. The spacer according to claim 13, wherein:

the at least one curved side wall segment has a half-circle shape in cross-section and at least two of the plurality of side wall segments are planar in the direction parallel to the longitudinal direction and extend in parallel to each other.

15. The spacer according to claim 14, wherein the two parallel end faces are defined on opposite ends of the spacer body in the longitudinal direction, the two parallel end faces being flat and respectively extending in first and second planes that are each perpendicular to the longitudinal direction.

16. The spacer according to claim 15, wherein the first and second plurality of bars each comprise at least four bars.

17. The spacer according to claim 16, further comprising:

a first half-cylindrical portion disposed at, and connecting, a first set of the terminal ends of two adjacent bars of the first plurality of bars, and a second half-cylindrical portion disposed at, and connecting, a second set of the terminal ends of two adjacent bars of the first plurality of bars, wherein the first and second half-cylindrical portions are separated from each other by two co-linear gaps.

18. The spacer according to claim 17, wherein the bars of the first plurality of bars and the bars of the second plurality of bars are respectively spaced from each other along the interior surface of the at least one exterior wall by one or more angles between 40-120°.

19. The spacer according to claim 18, further comprising:

a connection wall extending in the interior space between the first and second fastener insertion paths and connecting the first half-cylindrical portion to a third half-cylindrical portion disposed at, and connecting, the terminal ends of at least two adjacent bars of the second plurality of bars.

20. A method comprising:

inserting a first fastener through a cladding element and then into the first fastener insertion path of the spacer according to claim 1, thereby forming a captive assembly of the fastener, cladding element and the spacer;

inserting a second fastener through the cladding element and then into the second fastener insertion path of the spacer; and engaging the first fastener and the second fastener into a structural building element, thereby forming an assembly of the cladding element retained on the structural building element in a spaced apart relationship.

* * * * *